US009107003B2

(12) United States Patent
Dix et al.

(10) Patent No.: US 9,107,003 B2
(45) Date of Patent: Aug. 11, 2015

(54) EXTENDED DUCT WITH DAMPING FOR IMPROVED SPEAKER PERFORMANCE

(75) Inventors: Gordon R. Dix, Sunnyvale, CA (US); Justin Derry Crosby, Cupertino, CA (US); Martin E. Johnson, Los Gatos, CA (US); Michael Kai Morishita, Belmont, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/327,649

(22) Filed: Dec. 15, 2011

(65) Prior Publication Data

US 2013/0156245 A1 Jun. 20, 2013

(51) Int. Cl.
*H04R 1/28* (2006.01)

(52) U.S. Cl.
CPC ..... *H04R 1/2873* (2013.01); *H04R 1/288* (2013.01); *H04R 2499/15* (2013.01)

(58) Field of Classification Search
CPC .. H04R 1/2823; H04R 1/2807; H04R 1/2826; H04R 1/2846; H04R 1/2849; H04R 1/2815; H04R 1/2873; H04R 1/288; H04R 2499/15; H04R 2499/11
USPC ..... 381/336–338, 370–384
See application file for complete search history.

(56) References Cited

U.S. PATENT DOCUMENTS 5,022,486 A * 6/1991 Miura et al. ..... 181/132
5,225,639 A 7/1993 Kobayashi et al.
5,261,006 A * 11/1993 Nieuwendijk et al. ..... 381/353
5,604,337 A * 2/1997 Sugimoto et al. ..... 181/152
5,696,357 A 12/1997 Starobin
5,737,435 A 4/1998 De Poortere et al.
6,130,951 A 10/2000 Nakamura et al.
6,356,643 B2 3/2002 Yamagishi et al.
6,359,994 B1 * 3/2002 Markow et al. ..... 381/333
6,751,330 B2 6/2004 Kowaki et al.
7,433,483 B2 10/2008 Fincham
7,840,023 B2 11/2010 Easton
7,869,617 B2 * 1/2011 Jang et al. ..... 381/396
8,213,666 B2 * 7/2012 Groesch ..... 381/376
8,290,179 B2 * 10/2012 Gregg et al. ..... 381/98
2007/0132911 A1 * 6/2007 Fujiwara et al. ..... 349/58

(Continued)

FOREIGN PATENT DOCUMENTS

CN 1706231 12/2005
DE 19601217 7/1997

(Continued)

OTHER PUBLICATIONS

Chinese Office Action dated Jan. 19, 2015, Chinese Appln. No. 201210424356.9 with English-language translation, 26 pages.

(Continued)

*Primary Examiner* — Davetta W Goins
*Assistant Examiner* — Jasmine Pritchard
(74) *Attorney, Agent, or Firm* — Blakely, Sokoloff, Taylor & Zafman LLP

(57) ABSTRACT

An electronic audio device including an enclosure having an acoustic output opening and a speaker positioned within the enclosure. The speaker and the acoustic output opening are acoustically coupled by an acoustic output pathway. The acoustic output pathway includes a damping chamber to dampen a resonance frequency of the acoustic output pathway. The speaker is between the damping chamber and the acoustic output opening.

29 Claims, 6 Drawing Sheets

(56) References Cited

U.S. PATENT DOCUMENTS

| | | | | |
|---|---|---|---|---|
| 2011/0037906 | A1* | 2/2011 | Gawronski et al. | 348/738 |
| 2014/0093113 | A1* | 4/2014 | Dix et al. | 381/346 |
| 2014/0112512 | A1* | 4/2014 | Su et al. | 381/333 |
| 2014/0166390 | A1* | 6/2014 | Center et al. | 181/199 |

FOREIGN PATENT DOCUMENTS

| | | |
|---|---|---|
| EP | 0360517 | 3/1990 |
| EP | 0429121 | 5/1991 |
| EP | 0744880 | 11/1996 |
| GB | 2408405 | 5/2005 |
| JP | 08331685 | 12/1996 |
| JP | 2606447 | 2/1997 |
| JP | 09-149487 | 6/1997 |
| JP | 10066184 | 3/1998 |
| JP | 11-259011 | 9/1999 |
| JP | 2000115898 | 4/2000 |
| JP | 2001-145186 | 5/2001 |
| KR | 102010012962 | 12/2010 |
| WO | WO-9119406 | 12/1991 |
| WO | WO-9945742 | 9/1999 |

OTHER PUBLICATIONS

Extended European Search Report mailed Apr. 3, 2013, EP Appln. No. 12189363.0.

International Preliminary Report on Patentability for corresponding International Application No. PCT/US2012/057346, mailing date Jun. 26, 2014, 9 pages.

Australian Office Action dated Sep. 10, 2013, Australian Appln. No. 2012238200, 3 pages.

Korean Office Action dated Oct. 28, 2013, Korean Appln. No. 10-2012-120915, with English translation, 6 pages.

Japanese Office Action dated Oct. 17, 2013, Japanese Appln. No. 2012-234178, with English translation, 6 pages.

Russell, D. A., "Acoustic high-pass, low-pass, and band-stop filters", http://www.kettering.edu/physics/drussell/GMI-Acoustics/Filters.html, GMI Engineering & Management Institute; Kettering University, (Mar. 6, 1997), 8 pages.

PCT Search Report and Written Opinion mailed Dec. 21, 2012, PCT Appln. No. PCT/US2012/057346 filed Sep. 26, 2012.

Canadian Office Action dated Oct. 17, 2014, Canadian Appln. No. 2,731,432, 4 pages.

* cited by examiner

EXTENDED DUCT WITH DAMPING FOR IMPROVED SPEAKER PERFORMANCE

BACKGROUND

In modern consumer electronics, audio capability is playing an increasingly larger role as improvements in digital audio signal processing and audio content delivery continue to happen. There is a range of consumer electronics devices that are not dedicated or specialized audio playback devices, yet can benefit from improved audio performance. For instance, smart phones, portable personal computers such as laptop, notebook, and tablet computers, and desktop personal computers with built-in speakers. Integrating speakers into such devices in a manner that promotes optimal sound output is challenging. For example, in cases where the speakers are built into the device and hidden from view, sound waves output from the speaker must travel a distance within the enclosure before they exit the device. The pathway through which the sound waves travel may have resonances associated with it that cause the output from the device to vary with frequency. In particular, at some frequencies, the device may have a lot of output sound power for a given input power (resonance of the pathway) and at other frequencies the system has very little sound power output for a given input power (anti-resonances of the duct). These variations result in a reduction in audio quality.

SUMMARY

An embodiment of the invention is an electronic audio device including an enclosure having an acoustic output opening and a speaker positioned within the enclosure. The speaker may be acoustically coupled to the acoustic output opening by an acoustic output pathway. The acoustic output pathway may have any size or shape, and in some embodiments, may be a duct. One or more damping chambers may be connected to the acoustic output pathway or duct at a position upstream from the speaker. The one or more damping chambers may include an acoustic damping material that dampens a resonance frequency of the pathway and/or absorbs sound waves generated by the speaker. Since the damping chamber is positioned upstream from the speaker, it does not interfere with sound waves traveling downstream from the speaker, toward the acoustic output opening. Instead, the damping chamber absorbs sound waves reflected by the acoustic output opening in an upstream direction toward the speaker. In some embodiments, the damping chamber may have a neck portion that is dimensioned to dampen a specific resonance frequency of the acoustic output pathway. In embodiments where additional damping chambers are provided, each of the damping chambers may be tuned to dampen different resonance frequencies of the acoustic output pathway.

The above summary does not include an exhaustive list of all aspects of the embodiments disclosed herein. It is contemplated that the embodiments may include all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments disclosed herein are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments with reference to the appended drawings. Whenever the shapes, relative positions and other aspects of the parts described in the embodiments are not clearly defined, the scope of the embodiments is not limited only to the parts shown, which are meant merely for the purpose of illustration. Also, while numerous details are set forth, it is understood that some embodiments may be practiced without these details. In other instances, well-known structures and techniques have not been shown in detail so as not to obscure the understanding of this description.

Figure 1:
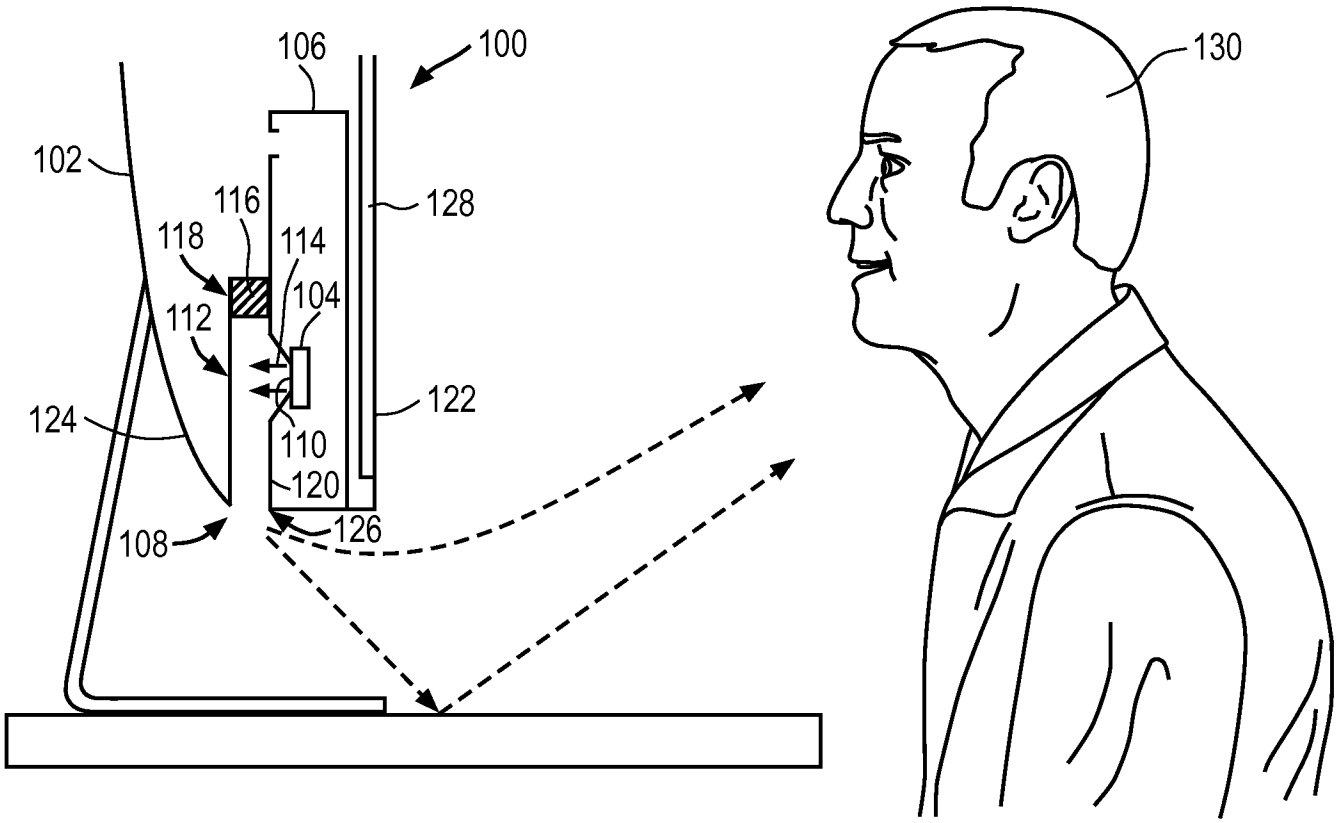
FIG. 1 is a side cross-sectional view of an embodiment of an electronic device having an acoustic output pathway and damping chamber.

FIG. 1 is a side cross-sectional view of an embodiment of an electronic audio device having an acoustic output pathway and damping chamber. In some embodiments, electronic audio device 100 may be a desktop computer. In still further embodiments, electronic audio device 100 may be any type of electronic device having built-in speakers, for example, a smart phone, portable personal computer such as laptop, notebook, or tablet computer; a portable radio, cassette or compact disk (CD) player. Still further, electronic audio device 100 may be a telecommunications device such as a television or a DVD player or interactive video gaming machine. Electronic audio device 100 may include enclosure 102 which houses the various electronic device components, for example, a display 128 such as a flat panel liquid crystal display (LCD) viewed by user 130 and speaker 104. Speaker 104 is built into frame 106 which may be of a typical material used for speaker enclosures, such as plastic. Frame 106 may be integrally formed as part of enclosure 102 or may be a separate component mounted within enclosure 102. Enclosure 102 may include an acoustic output port 108 through which a sound emitted from a sound emitting surface or face 110 of speaker 104 may exit electronic audio device 100 to the environment outside of enclosure 102.

Figure 2:
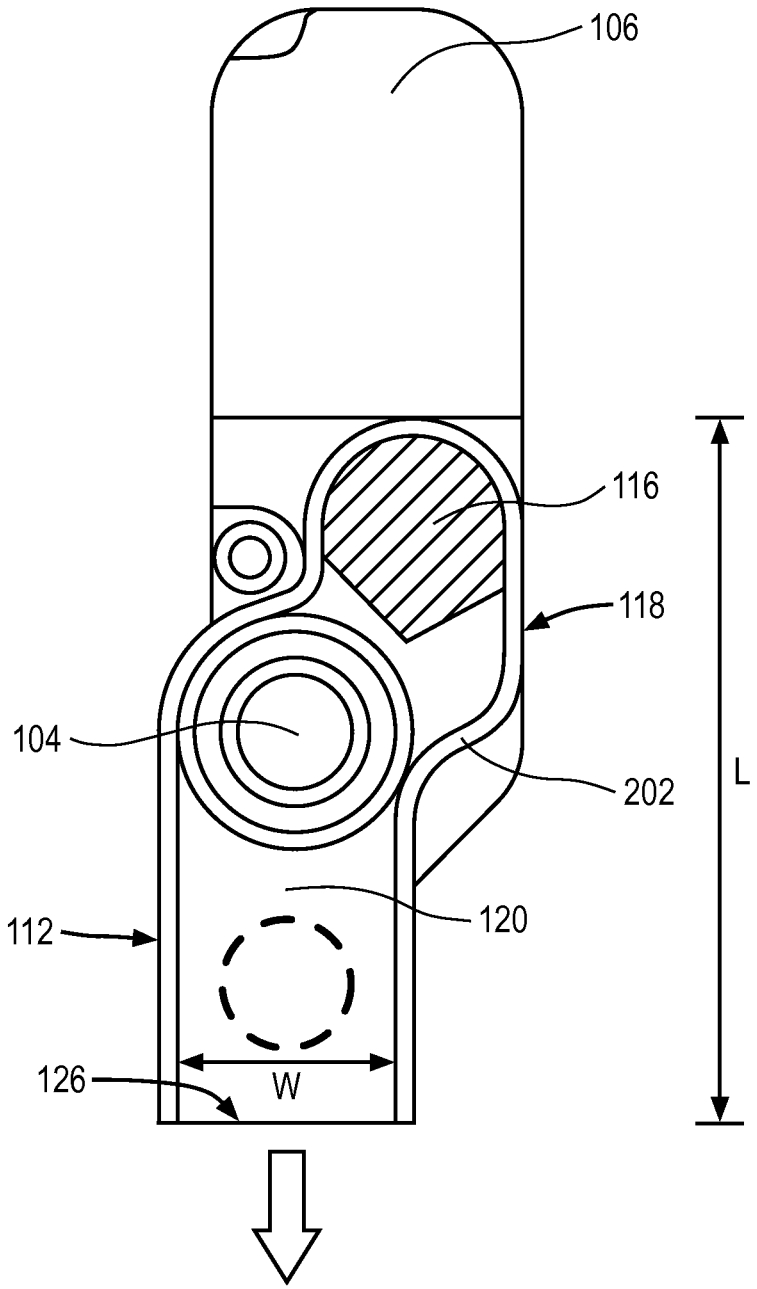
FIG. 2 is a back side view of the acoustic output pathway and damping chamber of FIG. 1.

An acoustic output pathway 112 may be formed between speaker 104 and acoustic output port 108 to direct sound waves 114 emitted from face 110 of speaker 104 toward acoustic output port 108. In some embodiments, acoustic output pathway 112 is a duct that forms an acoustic channel between speaker 104 and acoustic output port 108. In this aspect, acoustic output pathway 112 may be an elongated channel having a length greater than its width. For example, as illustrated in FIG. 2, acoustic output pathway 112 may have a width (w) that is substantially equivalent to a diameter of speaker 104 and a length (l) that is at least two times the diameter of speaker 104, in other words the length is at least twice as long as the width. In other embodiments, acoustic output pathway 112 has any structure suitable for transmitting sound waves between speaker 104 and acoustic output port 108, for example, a square, circular, elliptical or triangular shape.

An end of acoustic output pathway 112 may form exit port 126, which is aligned with acoustic output opening 108 of enclosure 102 (when pathway 112 is formed by a structure separate from enclosure 102, for example, a separate frame 106), so that sound traveling through acoustic output pathway 112 exits enclosure 102 through acoustic output opening 108. Alternatively, acoustic output pathway 112 may be formed by frame 106 integrally formed with enclosure 102 such that exit port 126 and acoustic output opening 108 are at the same location. Although in the illustrated embodiment, acoustic output port 108 is shown formed within a portion of the bottom wall of enclosure 102 aligned with the end of acoustic output pathway 112, it is further contemplated that the acoustic output port may be formed through a front, back or side wall of enclosure 102. For example, the acoustic output port may be formed through front wall 122 of enclosure 102 and instead of having exit port 126 at the end of pathway 112, exit port 126 may be formed within a portion of front face 120 of pathway 112 aligned with the acoustic output opening so that sound from speaker 104 can exit device 100 through a front of device 100. It is further contemplated that, although not illustrated, acoustic output pathway 112 may include a vent hole for tuning of pathway 112.

Sound waves 114 emitted from face 110 of speaker 104 travel down acoustic output pathway 112 toward acoustic output port 108. When sound waves 114 reach acoustic output port 108, some of waves 114 exit enclosure 102 and some of waves 114 are reflected off of sound output port 108 and propagate back upstream, toward speaker 114. Waves 114 traveling upstream are reflected off a portion of acoustic output pathway 112 upstream from speaker 104 and travel back downstream toward acoustic output port 108. Waves 114 can continue to bounce between speaker 104 and acoustic output port 108. This bouncing of waves 114 up and down acoustic output pathway 112 means that a single wave exiting speaker 104 actually exits acoustic output pathway 112 as a series of waves over a period of time. The bouncing of waves 114 back and forth, however, causes a reduction in audio quality of device 100 because they interfere with one another. In addition, resonances of acoustic output pathway 112 may cause sound output from device 100 to vary with frequency. Specifically, wave frequencies that match the resonances of acoustic output pathway 112 will cause sound waves output from device 100 to be more powerful at a given input power while at other frequencies that do not match the resonance of acoustic output pathway 112, the waves may have very little sound power output for a given input power (i.e. anti-resonances of the duct).

Damping chamber 118 is therefore provided to minimize the effects the resonance frequency of acoustic output pathway 112 and the bouncing of waves 114 between speaker 104 and acoustic output port 108 have on the quality of sound emitted from device 100. In other words, damping chamber 118 dampens an acoustic response of acoustic output pathway 112. Damping chamber 118 may be a separate cavity connected to a portion of acoustic output pathway 112 or formed by an end of acoustic output pathway 112. Damping chamber 118 may have a size and shape suitable to dampen a resonance frequency of acoustic output pathway and/or absorb one or more of sound waves 114 traveling within acoustic output pathway 112 upstream of speaker 104.

In some embodiments, damping chamber 118 may include an acoustic damping material 116 that is placed within damping chamber 118 and secured with, for example, an adhesive, glue or the like. Acoustic damping material 116 may be any material capable of absorbing sound waves and/or dampening a resonance frequency of acoustic output pathway 112. Suitable acoustic damping materials may include, but are not limited to, for example, sponge, fiberglass, foam or a perforated material. In other embodiments, one or more of the walls forming damping chamber 118 may be made of an acoustic damping material. Representatively, damping chamber 118 may include a wall, portion of a wall or other structure that is made of fiberglass or other suitable damping material.

Damping chamber 118 may be formed at a position along acoustic output pathway 112 upstream from speaker 104, in other words speaker 104 is positioned between damping chamber 118 and acoustic output port 108. In some embodiments, speaker 104 may be positioned at a point along acoustic output pathway 112 that is halfway between exit port 126 (or acoustic output port 108) and the closed end of damping chamber 118. In other embodiments, speaker 104 is positioned at any point between the halfway point and the closed end of damping chamber 118 such that speaker 104 is closer to the end of damping chamber 118 than exit port 126.

Speaker 104 may be mounted within a face 120 of acoustic output pathway 112 connecting opposing ends of acoustic output pathway 112 and damping chamber 118 is formed at the end of acoustic output pathway 112 opposite to exit port 126 and acoustic output opening 108. In some embodiments, face 120 may be formed by a side of frame 106 having speaker 104 mounted therein and the opposing face of acoustic output pathway 112 may be formed by enclosure 102. In other embodiments, acoustic output pathway 112 and damping chamber 118 are integrally formed by enclosure 102 such that the entire pathway 112, damping chamber 118 and frame 106 system is one integrally formed piece made of the same material (e.g. a molded piece). Since damping chamber 118 is upstream to speaker 104, damping chamber 118 does not interfere with sound waves 114 traveling downstream from speaker 104, toward acoustic output port 108. Instead, damping chamber 118 absorbs sounds waves 114 that are deflected back upstream from acoustic output port 108 and prevents them from further interfering with sound waves 114 traveling within acoustic output pathway 112. In addition, acoustic damping material 116 may dampen a resonance of acoustic output pathway 112 as previously discussed, which further improves sound output from device 100.

FIG. 2 is a back side view of the acoustic output pathway and damping chamber of FIG. 1. From this view, it can be seen that speaker 104 is mounted within an opening formed along face 120 of acoustic output pathway 112. In addition, side wall 202 extends perpendicular to face 120 to form an elongated channel having exit port 126 at the end of acoustic output pathway 112. Alternatively, the exit port may be formed through face 120 of acoustic output pathway 112 as illustrated by phantom lines. Side wall 202 may be sealed to a portion of back wall 124 of enclosure 102 to form acoustic output pathway 112 and damping chamber 118. In other embodiments, as previously discussed, acoustic output pathway 112 and damping chamber 118 are integrally formed by frame 106, which is formed by enclosure 102, such that side wall 202 and the back face sealing pathway 112 and damping chamber 118 are formed by frame 106. In some embodiments, damping chamber 118 is formed off-axis to that of acoustic output pathway 112. In other embodiments, damping chamber 118 may be on-axis or aligned with an axis of acoustic output pathway 112.

Figure 3:
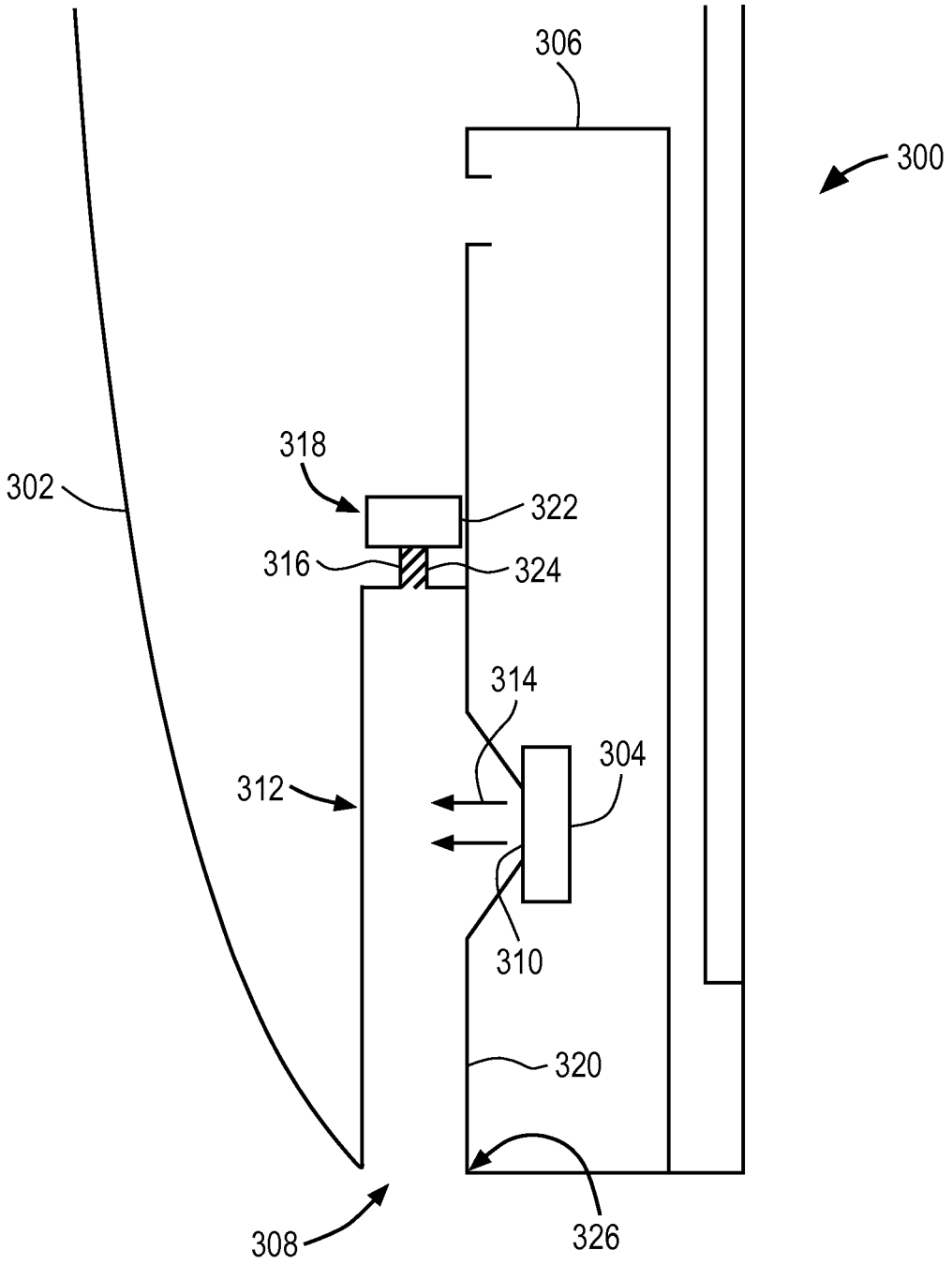
FIG. 3 is a side cross-sectional view of an embodiment of an acoustic output pathway and damping chamber.

FIG. 3 is a side cross-sectional view of an embodiment of an acoustic output pathway and damping chamber. Electronic audio device 300 includes enclosure 302 having speaker 304 mounted to frame 306 positioned therein. Sound waves 314 emitted from face 310 of speaker 304 travel to acoustic output port 308 of enclosure 302 through exit port 326 of acoustic output pathway 312. Damping chamber 318 is formed at an end of acoustic output pathway 312 upstream from speaker 304. In some embodiments, acoustic output pathway 312 and damping chamber 318 are formed separately from frame 306 and mounted to frame 306 while in other embodiments, acoustic output pathway 312, damping chamber 318 and frame 306 are integrally formed together as a single piece, such as by molding. In this embodiment, damping chamber 318 is configured to dampen a particular resonance frequency of acoustic output pathway 312. In this aspect, damping chamber 318 includes chamber portion 322 connected to the end of acoustic output pathway 312 by neck portion 324. Neck portion 324 may be configured to dampen a first resonance frequency of acoustic output pathway 312. For example, neck portion 324 may have a narrow cross-sectional size relative to chamber portion 322 that is suitable for dampening the first resonance frequency. It is contemplated, however, that a size and shape of neck portion 324 may vary depending upon the resonance frequency neck portion 324 is designed to dampen. In some embodiments, acoustic damping material 316 may be positioned within neck portion 324.

Figure 4:
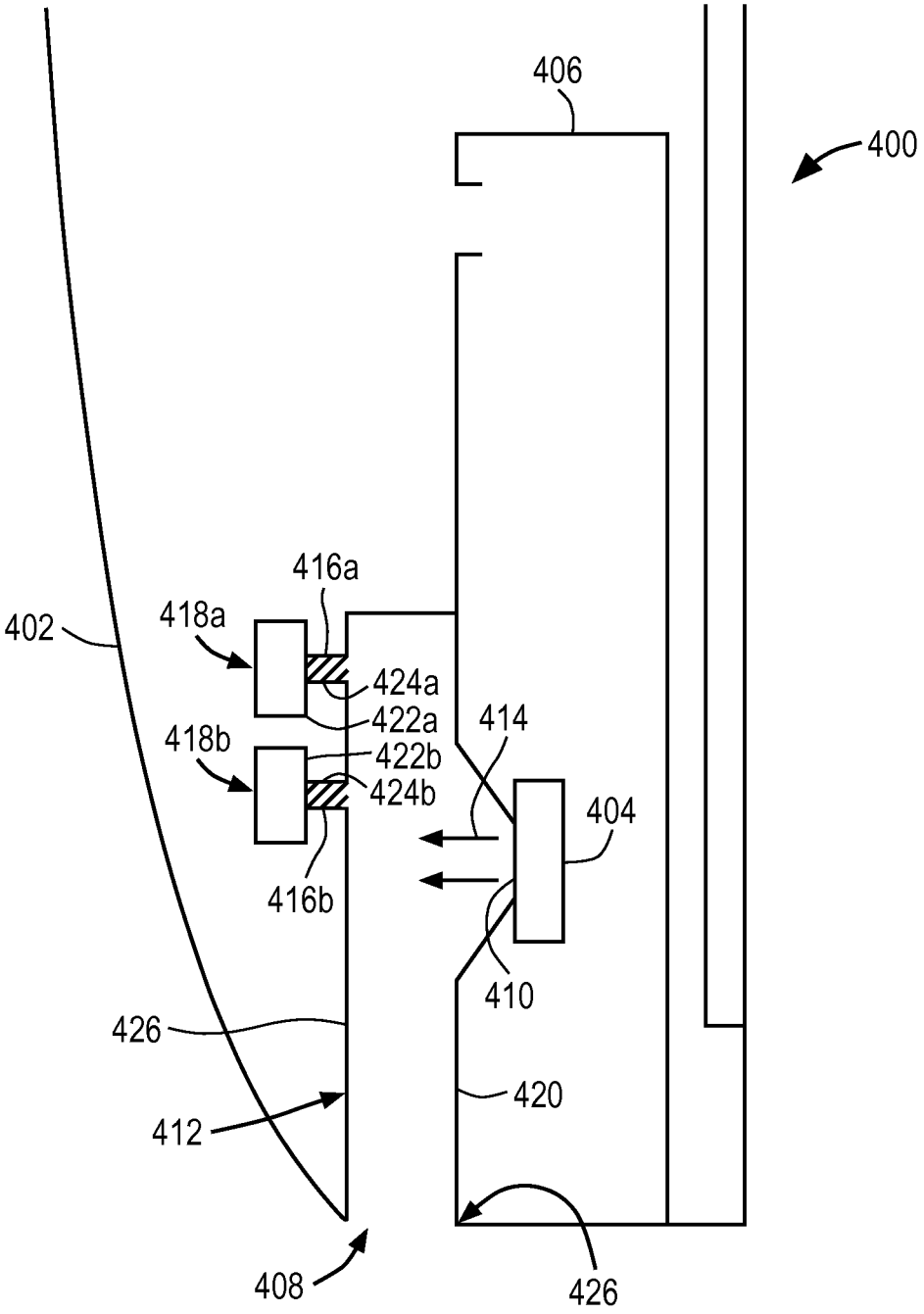
FIG. 4 is a side cross-sectional view of an embodiment of an acoustic output pathway and damping chamber.

FIG. 4 is a side cross-sectional view of an embodiment of an acoustic output pathway and damping chamber. Electronic audio device 400 is substantially similar to electronic audio device 300 described in reference to FIG. 3 except that in this embodiment, acoustic output pathway 412 includes more than one damping chamber. In particular, electronic audio device 400 includes enclosure 402 having speaker 404 mounted to frame 406. Sound waves 414 emitted from face 410 of speaker 404 travel to acoustic output port 408 of enclosure 402 through exit port 426 of acoustic output pathway 412. Acoustic output pathway 412 may include damping chambers 418*a* and 418*b* formed along a portion of acoustic output pathway 412 upstream from speaker 404. In some embodiments, acoustic output pathway 412 and damping chambers 418*a*, 418*b* are formed separately from frame 406 and mounted to frame 406 while in other embodiments, acoustic output pathway 412, damping chambers 418*a*, 418*b* and frame 406 are integrally formed together as a single piece, such as by molding. Although damping chambers 418*a* and 418*b* are shown formed along face 420 of acoustic output pathway 412, which is opposite to face 420, it is contemplated that damping chambers 418*a*, 418*b* may be formed along any portion of acoustic output pathway that is upstream to speaker 404. For example, damping chamber 418*a* may be formed at an end of acoustic output pathway 412 and damping chamber 418*b* may be formed along face 420 of acoustic output pathway 412. Damping chamber 418*a* may include chamber portion 422*a* connected to acoustic output pathway 412 by neck portion 424*a*. Similarly, damping chamber 418*b* may include chamber portion 422*b* connected to acoustic output pathway 412 by neck portion 424*b*. In other embodiments, damping chambers 418*a* and 418*b* may have different shapes. Still further, although two damping chambers 418*a*, 418*b* are illustrated, it is contemplated that more than two or less than two damping chambers may be used.

Neck portions 424*a* and 424*b* may be configured to dampen particular resonance frequencies of acoustic output pathway 412. For example, in one embodiment, neck portion 424*a* may be configured to dampen a first resonance frequency of acoustic output pathway 412 and neck portion 424*b* may be configured to dampen a second resonance frequency of acoustic output pathway 412. In this aspect, each of neck portions 424*a* and 424*b* may have different cross-sectional sizes than each other and chamber portions 422*a* and 422*b*, respectively. For example, where the first resonance frequency is lower than the second resonance frequency, neck portion 424*a* may be longer and narrower and chamber portion 422*a* may have a larger cross-sectional size (i.e. larger volume) than neck portion 424*b* and chamber portion 422*b*, respectively. It is contemplated, however, that a size and shape of neck portions 424*a* and 424*b* may vary depending upon the resonance frequency neck portion 424 is designed to dampen. Acoustic damping material 416*a* and 416*b* may be positioned within neck portions 424*a* and 424*b*, respectively.

Figure 5:
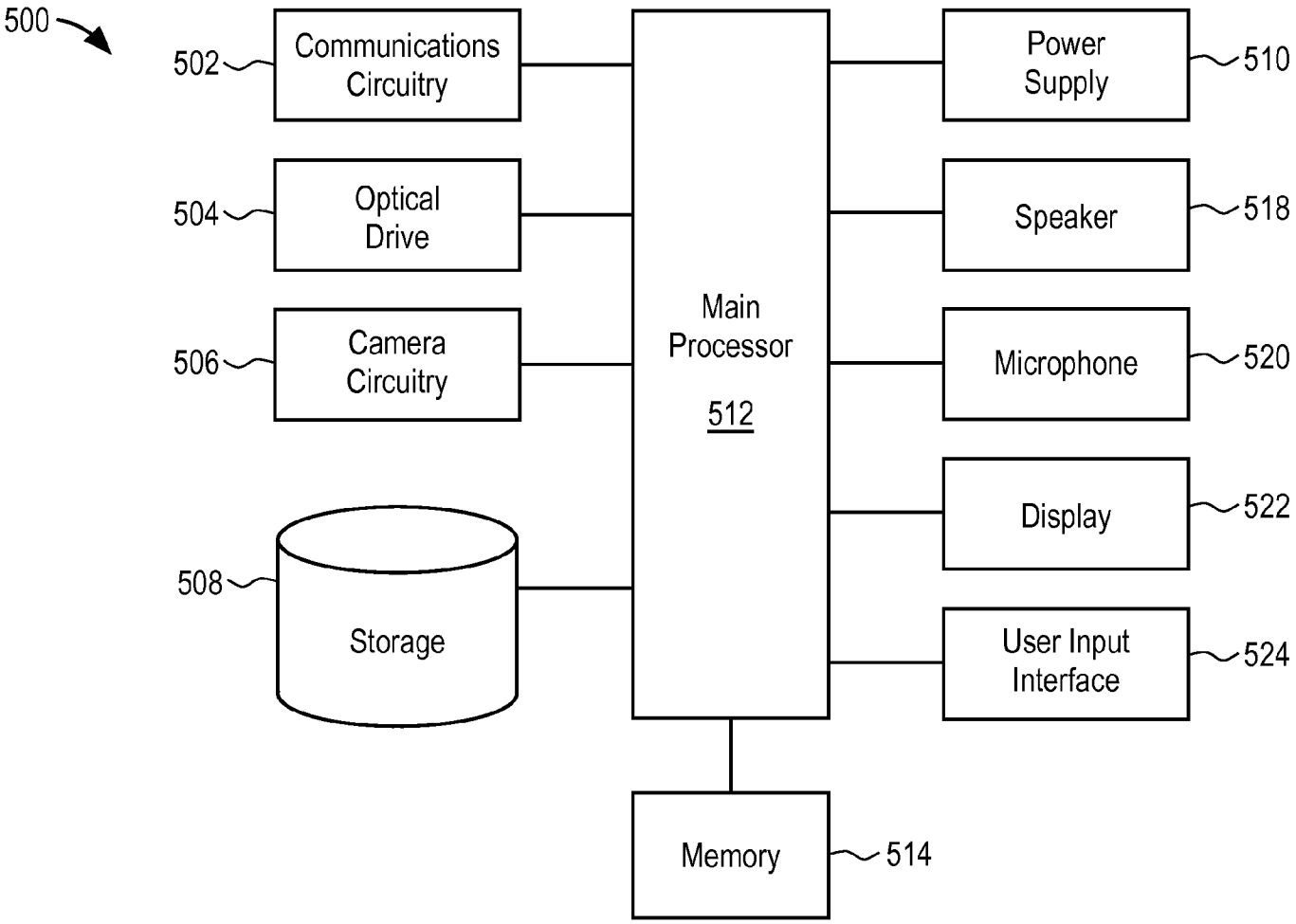
FIG. 5 is a block diagram of some of the constituent components of an embodiment of an electronic device.

FIG. 5 is a block diagram of some of the constituent components of an embodiment of an electronic audio device within which the previously described speaker and acoustic pathway having a dampening chamber may be implemented. Electronic audio device 500 may be any one of several different types of desk top electronic devices having a built-in speaker system, for example a desk top computer or a television. In this aspect, electronic audio device 500 includes a main processor 512 that interacts with camera circuitry 506, storage 508, memory 514, display 522, and user input interface 524. Main processor 512 may also interact with communications circuitry 502, optical drive 504, power supply 510, speaker 518, and microphone 520. The various components of the electronic audio device 500 may be digitally interconnected and used or managed by a software stack being executed by the main processor 512. Many of the components shown or described here may be implemented as one or more dedicated hardware units and/or a programmed processor (software being executed by a processor, e.g., the main processor 512).

The main processor 512 controls the overall operation of the device 500 by performing some or all of the operations of one or more applications or operating system programs implemented on the device 500, by executing instructions for it (software code and data) that may be found in the storage 508. The processor may, for example, drive the display 522 and receive user inputs through the user input interface 524. In addition, processor 612 may send an audio signal to speaker 618 to facilitate operation of speaker 618.

Storage 508 provides a relatively large amount of "permanent" data storage, using nonvolatile solid state memory (e.g., flash storage) and a kinetic nonvolatile storage device (e.g., rotating magnetic disk drive). Storage 508 may include both local storage and storage space on a remote server. Storage 508 may store data as well as software components that control and manage, at a higher level, the different functions of the device 500.

In addition to storage 508, there may be memory 514, also referred to as main memory or program memory, which provides relatively fast access to stored code and data that is being executed by the main processor 512. Memory 514 may include solid state random access memory (RAM), e.g., static RAM or dynamic RAM. There may be one or more processors, e.g., main processor 512, that run or execute various software programs, modules, or sets of instructions (e.g., applications) that, while stored permanently in the storage 508, have been transferred to the memory 514 for execution, to perform the various functions described above. It should be noted that these modules or instructions need not be implemented as separate programs, but rather may be combined or otherwise rearranged in various combinations. In addition, the enablement of certain functions could be distributed amongst two or more modules, and perhaps in combination with certain hardware.

The device 500 may include communications circuitry 502. Communications circuitry 502 may include components used for wired or wireless communications, such as data transfers. For example, communications circuitry 502 may include Wi-Fi communications circuitry so that the user of the device 500 may transfer data through a wireless local area network.

The device 500 also includes camera circuitry 506 that implements the digital camera functionality of the device 500. One or more solid state image sensors are built into the device 500, and each may be located at a focal plane of an optical system that includes a respective lens. An optical image of a scene within the camera's field of view is formed on the image sensor, and the sensor responds by capturing the scene in the form of a digital image or picture consisting of pixels that may then be stored in storage 508. The camera circuitry 500 may be used to capture video images of a scene.

Device 500 also includes an optical drive 504 such as a CD or DVD optical disk drive that may be used to, for example, install software onto device 500.

Figure 6:
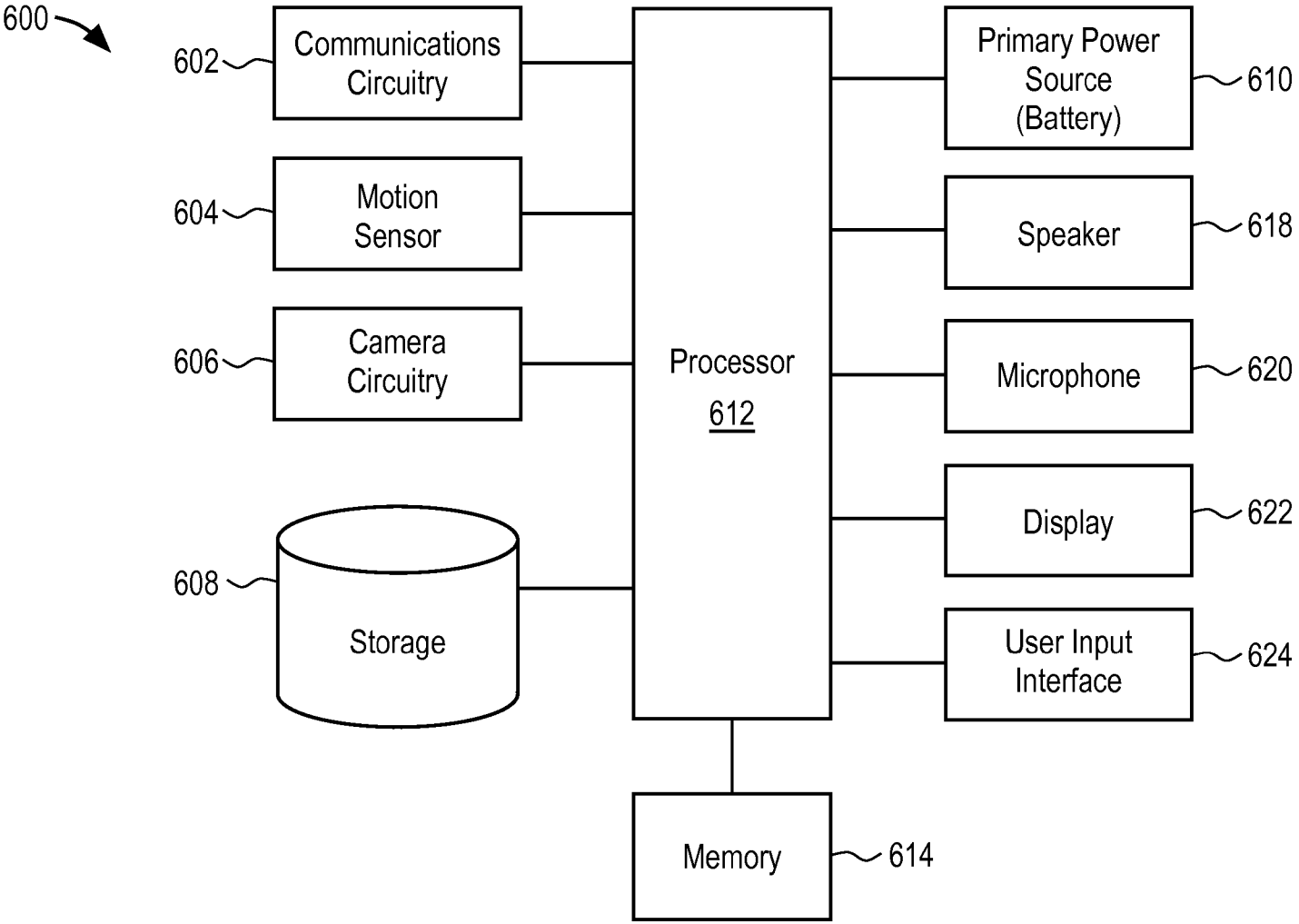
FIG. 6 is a block diagram of some of the constituent components of another embodiment of an electronic device.

FIG. 6 is a block diagram of some of the constituent components of another embodiment of an electronic device within which the previously described speaker driver and acoustic pathway having a dampening chamber may be implemented. Device 600 may be any one of several different types of consumer electronic devices that can be easily held in the user's hand during normal use. In particular, the device 600 may be any speaker-equipped mobile device, such as a cellular phone, a smart phone, a media player, or a tablet-like portable computer, all of which may have a built-in speaker system.

In this aspect, electronic audio device 600 includes a processor 612 that interacts with camera circuitry 606, motion sensor 604, storage 608, memory 614, display 622, and user input interface 624. Processor 612 may also interact with communications circuitry 602, primary power source 610, speaker 618, and microphone 620. The various components of the electronic audio device 600 may be digitally interconnected and used or managed by a software stack being executed by the processor 612. Many of the components shown or described here may be implemented as one or more dedicated hardware units and/or a programmed processor (software being executed by a processor, e.g., the processor 612).

The processor 612 controls the overall operation of the device 600 by performing some or all of the operations of one or more applications or operating system programs implemented on the device 600, by executing instructions for it (software code and data) that may be found in the storage 608. The processor may, for example, drive the display 622 and receive user inputs through the user input interface 624. (which may be integrated with the display 622 as part of a single, touch sensitive display panel). In addition, processor 612 may send an audio signal to speaker 618 to facilitate operation of speaker 618.

Storage 608 provides a relatively large amount of "permanent" data storage, using nonvolatile solid state memory (e.g., flash storage) and a kinetic nonvolatile storage device (e.g., rotating magnetic disk drive). Storage 608 may include both local storage and storage space on a remote server. Storage 608 may store data as well as software components that control and manage, at a higher level, the different functions of the device 600.

In addition to storage 608, there may be memory 614, also referred to as main memory or program memory, which provides relatively fast access to stored code and data that is being executed by the processor 612. Memory 614 may include solid state random access memory (RAM), e.g., static RAM or dynamic RAM. There may be one or more processors, e.g., processor 612, that run or execute various software programs, modules, or sets of instructions (e.g., applications) that, while stored permanently in the storage 608, have been transferred to the memory 614 for execution, to perform the various functions described above.

The device 600 may include communications circuitry 602. Communications circuitry 602 may include components used for wired or wireless communications, such as two-way conversations and data transfers. For example, communications circuitry 602 may include RF communications circuitry that is coupled to an antenna, so that the user of the device 600 can place or receive a call through a wireless communications network. The RF communications circuitry may include a RF transceiver and a cellular baseband processor to enable the call through a cellular network. For example, communications circuitry 602 may include Wi-Fi communications circuitry so that the user of the device 600 may place or initiate a call using voice over Internet Protocol (VOIP) connection, transfer data through a wireless local area network.

The device 600 may include a motion sensor 604, also referred to as an inertial sensor, that may be used to detect movement of the device 600. The motion sensor 604 may include a position, orientation, or movement (POM) sensor, such as an accelerometer, a gyroscope, a light sensor, an infrared (IR) sensor, a proximity sensor, a capacitive proximity sensor, an acoustic sensor, a sonic or sonar sensor, a radar sensor, an image sensor, a video sensor, a global positioning (GPS) detector, an RP detector, an RF or acoustic doppler detector, a compass, a magnetometer, or other like sensor. For example, the motion sensor 600 may be a light sensor that detects movement or absence of movement of the device 600, by detecting the intensity of ambient light or a sudden change in the intensity of ambient light. The motion sensor 600 generates a signal based on at least one of a position, orientation, and movement of the device 600. The signal may include the character of the motion, such as acceleration, velocity, direction, directional change, duration, amplitude, frequency, or any other characterization of movement. The processor 612 receives the sensor signal and controls one or more operations of the device 600 based in part on the sensor signal.

The device 600 also includes camera circuitry 606 that implements the digital camera functionality of the device 600. One or more solid state image sensors are built into the device 600, and each may be located at a focal plane of an optical system that includes a respective lens. An optical image of a scene within the camera's field of view is formed on the image sensor, and the sensor responds by capturing the scene in the form of a digital image or picture consisting of pixels that may then be stored in storage 608. The camera circuitry 600 may also be used to capture video images of a scene.

Device 600 also includes primary power source 610, such as a built in battery, as a primary power supply.

While certain embodiments have been described and shown in the accompanying drawings, it is to be understood that such embodiments are merely illustrative of and not restrictive, and that the embodiments disclosed herein are not limited to the specific constructions and arrangements shown and described, since various other modifications may occur to those of ordinary skill in the art. For example, although the drawings show an acoustic output pathway in the shape of a duct, it is contemplated that the acoustic output pathway may have any shape such as a rectangular, square, circular or elliptical shape that could be implement within various components of an electronic device, for example, under a computer keyboard. The description is thus to be regarded as illustrative instead of limiting.

What is claimed is:

1. An electronic audio device comprising:

an enclosure and a base;

the enclosure having a bottom wall and a front wall, wherein an acoustic output opening is formed in the bottom wall of the enclosure and the front wall of the enclosure includes a flat panel display;

a speaker positioned within the enclosure, the speaker having a sound emitting surface positioned behind the flat panel display;

an acoustic output duct connecting the speaker to the acoustic output opening in the bottom wall of the enclosure, the acoustic output duct including a planar face and a sidewall connected to the planar face, the acoustic output duct having a damping chamber at a position upstream from the speaker and an exit port at a position downstream from the speaker, the planar face extending from the damping chamber to the exit port; and wherein the acoustic output opening in the bottom wall of the enclosure is positioned at a distance from a bottom of the base and sound emitted from the acoustic output opening is directed toward a plane that is parallel to the bottom of the base.

2. The electronic audio device of claim 1 further comprising an acoustic damping material positioned within the damping chamber to dampen a frequency of a sound wave emitted from the speaker.

3. The electronic audio device of claim 1 wherein a portion of the planar face forms the damping chamber and is made of an acoustic damping material.

4. The electronic audio device of claim 1 wherein the acoustic output duct comprises an opening along the planar face and the speaker is positioned within the opening.

5. The electronic audio device of claim 1 wherein the planar face and the sidewall form a channel along the back wall of the enclosure and wherein the speaker and the damping chamber are positioned along the planar face of the channel.

6. The electronic audio device of claim 1 wherein the damping chamber comprises a chamber portion and a neck portion, wherein the neck portion is between the chamber portion and the speaker, and wherein the neck portion comprises a damping material positioned therein and has a narrower cross-sectional size than the chamber portion so as to dampen a first resonance frequency of the acoustic output duct.

7. The electronic audio device of claim 6 wherein the damping chamber is a first damping chamber and the electronic device further comprises a second damping chamber connected to the acoustic output duct by a second neck portion, and wherein the second neck portion has a different cross-sectional size than the neck portion of the first damping chamber so as to dampen a second resonance frequency of the acoustic output duct.

8. The electronic audio device of claim 1 wherein the acoustic output duct and the damping chamber are a single integrally molded structure.

9. An electronic audio device comprising:

an enclosure and a base;

the enclosure having a front wall, a back wall and a bottom wall, wherein a flat panel display is mounted to the front wall and an acoustic output opening is formed in the bottom wall;

a speaker is positioned within a portion of the enclosure between the display and the back wall such that the speaker is spaced a distance from the acoustic output opening;

an acoustic output pathway acoustically coupling the speaker to the acoustic output opening that is formed in the bottom wall;

a damping chamber connected to the acoustic output pathway to dampen an acoustic response of the acoustic output pathway, the damping chamber positioned between the display and the back wall such that the speaker is positioned along the acoustic pathway between the damping chamber and the acoustic output opening in the bottom wall;

the acoustic output pathway including a planar face, and a sidewall connected to the planar face, wherein the planar face extends from the damping chamber to the acoustic output opening in the bottom wall, and a length of the pathway from the damping chamber to the acoustic output opening in the bottom wall is greater than its width; and wherein the acoustic output opening in the bottom wall of the enclosure is positioned at a distance from a bottom of the base and sound emitted from the acoustic output opening is directed toward the bottom of the base.

10. The electronic audio device of claim 9 further comprising an acoustic damping material positioned within the damping chamber.

11. The electronic audio device of claim 9 wherein the sidewall extends substantially perpendicular to the planar face and seals the acoustic output pathway to the back wall of the enclosure.

12. The electronic audio device of claim 9 wherein the planar face of the acoustic output pathway has an opening therein through which a sound emitting surface of the speaker is acoustically coupled to the acoustic output pathway.

13. The electronic audio device of claim 9 wherein the damping chamber comprises a chamber portion and a neck portion having a damping material positioned therein and wherein the neck portion is dimensioned to dampen a first resonance frequency of the acoustic output pathway.

14. The electronic audio device of claim 13 wherein the damping chamber is a first damping chamber and the electronic device further comprises a second damping chamber dimensioned to dampen a second resonance frequency of the acoustic output pathway, and wherein the first damping chamber and the second damping chamber extend from a side of the acoustic output pathway and are off-axis with respect to the acoustic output opening.

15. The electronic audio device of claim 1 wherein the sound emitting surface of the speaker is parallel to a screen face of the flat panel display.

16. The electronic audio device of claim 1 wherein a plane formed by the planar face of the acoustic output duct intersects the bottom wall of the enclosure.

17. An electronic audio device comprising:

an enclosure and a base;

the enclosure having a bottom wall and a front wall, wherein an acoustic output opening is formed in the bottom wall of the enclosure and the front wall of the enclosure includes a flat panel display;

a speaker positioned within the enclosure, the speaker having a sound emitting surface behind the flat panel display;

an acoustic output duct connecting the speaker to the acoustic output opening in the bottom wall of the enclosure, the acoustic output duct including a planar face and a sidewall connected to the planar face, the acoustic output duct having a damping chamber at a position upstream from the speaker and an exit port at a position downstream from the speaker, the planar face extending from the damping chamber to the exit port; and wherein the acoustic output opening in the bottom wall of the enclosure is positioned at a distance from a bottom of the base, and sound emitted by the speaker is directed out of the exit port of the duct and then out from the acoustic output opening in the bottom wall of the enclosure toward a surface on which the bottom of the base is to rest.

18. The device of claim 17 wherein the sound emitting surface of the speaker and the planar face of the duct are both parallel to a screen face of the flat panel display.

19. The device of claim 18, wherein the enclosure comprises a frame, and wherein the speaker is positioned within the frame.

20. The device of claim 19 wherein the frame is made of plastic.

21. The device of claim 17 further comprising a frame outside of the duct into which the speaker is built.

22. The device of claim 21 wherein the frame is made of plastic.

23. The device of claim 17, wherein the enclosure comprises a frame, wherein the planar face of the duct is formed by a side of the frame having the speaker mounted therein.

24. The device of claim 23 wherein the frame is made of plastic.

25. The device of claim 17 further comprising a plastic frame outside of the duct in which the speaker is mounted.

26. The device of claim 17 wherein the speaker is mounted within an opening formed along the planar face of the duct.

27. The device of claim 17 wherein the planar face of the duct has an opening therein through which the sound emitting surface of the speaker is acoustically coupled to the duct, and wherein the exit port of the duct is aligned with the acoustic output opening formed in the bottom wall of the enclosure.

28. The device of claim 17 wherein the sound emitting surface, from which the sound is emitted, faces away from a screen face of the flat panel display.

29. The device of claim 17 wherein a plane formed by the planar face of the duct intersects the bottom wall of the enclosure.

* * * * *